US010435890B2

(12) United States Patent
Wiens

(10) Patent No.: US 10,435,890 B2
(45) Date of Patent: Oct. 8, 2019

(54) JOINING TOOL FOR SIDE-LAPPED JOINTS

(71) Applicant: Nucor Corporation, Charlotte, NC (US)

(72) Inventor: David L. Wiens, Santa Monica, CA (US)

(73) Assignee: NUCOR CORPORATION, Charlotte, NC (US)

( * ) Notice: Subject to any disclaimer, the term of this patent is extended or adjusted under 35 U.S.C. 154(b) by 1042 days.

(21) Appl. No.: 13/624,237

(22) Filed: Sep. 21, 2012

(65) Prior Publication Data

US 2013/0074434 A1 Mar. 28, 2013

Related U.S. Application Data

(60) Provisional application No. 61/538,912, filed on Sep. 25, 2011.

(51) Int. Cl.
*E04D 15/04* (2006.01)
*B21D 39/03* (2006.01)

(52) U.S. Cl.
CPC ..... *E04D 15/04* (2013.01); *B21D 39/032* (2013.01); *B21D 39/035* (2013.01); *Y10T 29/49915* (2015.01); *Y10T 29/53791* (2015.01)

(58) Field of Classification Search
CPC .... B21D 39/02; B21D 39/021; B21D 39/026; B21D 39/031; E04D 3/368; E04D 15/04; B25B 5/064; B25B 5/065; B25B 5/04; B25B 1/04; Y10T 29/49915
USPC .... 29/243.5, 243.58, 509, 238; 72/324, 325, 72/409.01, 409.02, 409.11, 414, 450, 72/453.15, 453.16, 308; 269/238, 239
See application file for complete search history.

(56) References Cited

U.S. PATENT DOCUMENTS 1,949,718 A * 3/1934 Jackson ..... B66F 3/247 254/3 B
1,956,797 A * 5/1934 Jackson ..... B66F 3/247 254/3 B
4,072,118 A * 2/1978 Schultheiss ..... B21D 39/02 29/243.5
4,375,161 A * 3/1983 Braun ..... B25B 7/02 29/268
4,442,581 A * 4/1984 Molnick ..... B21D 39/025 269/158
4,531,397 A 7/1985 Pratt
5,208,973 A * 5/1993 Sawdon ..... B21D 39/031 29/243.5

(Continued)

FOREIGN PATENT DOCUMENTS

EP 0841139 A2 * 5/1998 ..... B29C 33/28
WO 20091058123 5/2009

*Primary Examiner* — Tyrone V Hall, Jr.
(74) *Attorney, Agent, or Firm* — Moore & Van Allen PLLC; Jeffrey R. Gray

(57) ABSTRACT

A joining tool is disclosed comprising a support; a stationary arm extending from the support at one end, the stationary arm comprising at the opposite end a first jaw; a movable arm pivotally mounted on the stationary arm; the movable arm driveable from the stationary arm in a pivotable motion by an actuator coupled to the moveable arm; and a second jaw coupled to the moveable arm, the moveable arm movable between an activated position in which the second jaw engages the first jaw and an initial position in which the second jaw is spaced from the first jaw.

17 Claims, 11 Drawing Sheets

(56) References Cited

U.S. PATENT DOCUMENTS

| | | | | |
|---|---|---|---|---|
| 5,878,617 | A * | 3/1999 | Parker | B21D 39/025 72/409.12 |
| 6,070,449 | A | 6/2000 | Vachon | |
| 6,212,932 | B1 | 4/2001 | Parker | |
| 6,397,469 | B2 | 6/2002 | Parker | |
| 6,990,781 | B2 * | 1/2006 | Sundstrom | E04D 3/368 29/432.2 |
| 7,021,108 | B2 * | 4/2006 | Bodwell | E04D 15/04 29/243.58 |
| 7,353,584 | B2 | 4/2008 | Defreese et al. | |
| 7,434,314 | B2 * | 10/2008 | Morton | B21D 39/021 29/243.5 |
| 7,621,165 | B2 | 11/2009 | Boltz | |
| 7,845,132 | B2 | 12/2010 | Morton | |
| 8,104,156 | B2 * | 1/2012 | Morton | B21D 39/021 29/243.5 |
| 8,667,656 | B1 * | 3/2014 | Morton | B21D 39/034 29/243.5 |
| 2001/0039704 | A1 | 11/2001 | Parker | |
| 2004/0093925 | A1 * | 5/2004 | Bodwell | E04D 15/04 72/325 |
| 2008/0028595 | A1 * | 2/2008 | DeFreese | B21D 39/02 29/566.1 |
| 2013/0074434 | A1 * | 3/2013 | Wiens | B21D 39/032 52/528 |

* cited by examiner

JOINING TOOL FOR SIDE-LAPPED JOINTS

TECHNICAL FIELD

The present disclosure relates generally to a tool and method for reliably fastening together side-lapped edges of adjacent deck panels used to form flooring and roofing of buildings.

BACKGROUND

Structural steel decking is typically manufactured in thicknesses ranging from 24 gauge to 16 gauge or more. The decking generally is supplied to the building site in panels ranging in size. Longitudinal ribs, typically hat sections or flat-bottomed vee sections of from 11/2 to 7 inches in depth are formed in the panels to increase the section modulus of the panels. The individual panels are typically provided with one edge having an exposed upward "male" lip. The opposite edge is provided with a relief inverted "U" shaped (e.g., "female") lip. The individual panels are joined together by placing the relief lip over the male lip and joined to form joints at periodic intervals. In many applications, the joints must secure the panels together so as not only to prevent one panel from lifting off the other, but also to prevent the panels from shifting laterally along the seam when exposed to shear forces. By holding the panels securely enough to prevent lateral shifting, the assembled decking adds considerable membrane strength to the finished building. Methods for attaching the side-lapped joints of fluted steel deck panels are well known, and include welding, button-punching, sheet metal screws, riveting, and mechanical deformation of the metal forming such side-lapped joints.

In many instances, side-lapped joints of a steel deck diaphragm must be inspected for consistency and integrity before further construction of a building may proceed. To avoid construction delays, it is desirable to form such side-lapped joints in a manner that allows the joints to be inspected quickly and easily, preferably from the top side of the decking.

SUMMARY

In a first embodiment, a joining tool is provided. The joining tool comprising: a support; a stationary arm extending from the support at one end, the stationary arm comprising at the opposite end a first jaw; a movable arm pivotally mounted on the stationary arm; the movable arm driveable from the stationary arm in a pivotable motion by an actuator coupled to the moveable arm; and at least one mating second jaw coupled to the moveable arm, the moveable arm movable between an activated position in which the second jaw engages the first jaw and an initial position in which the second jaw is spaced from the first jaw.

In one aspect of the first embodiment, the first jaw comprises at least one male die and at least one female die arranged in spaced linear alignment in correspondence with at least one male die and female die in spaced linear alignment on the second jaw.

In another aspect, alone or in combination with any previous aspect of the first embodiment, the actuator is fixedly mounted on the moveable arm and extends a piston secured to the stationary arm.

In another aspect, alone or in combination with any previous aspect of the first embodiment, the actuator comprises a piston-and-cylinder assembly with a piston extending therefrom, the piston having an end opposite the piston-and-cylinder assembly connected to the stationary arm, the piston extending away from the stationary arm.

In another aspect, alone or in combination with any previous aspect of the first embodiment, the at least one male die is arranged in spaced linear alignment and extend transverse to a longitudinal axis of the support. In another aspect, the tool comprises a plurality of male dies and a plurality of female dies, the plurality of male dies arranged n spaced linear alignment and extend transverse to a longitudinal axis of the support.

In another aspect, alone or in combination with any previous aspect of the first embodiment, each male die has a generally cylindrical cross section, each female die having a recess to receive the mating male die.

In another aspect, alone or in combination with any previous aspect of the first embodiment, the tool is portable and/or lightweight.

In another aspect, alone or in combination with any previous aspect of the first embodiment, the tool further comprises a mounted wheel support assembly fixedly attached to the tool, the wheel assembly having one or more wheels adapted to move between a first position in which the wheels are in contact with decking sections for transporting the tool along the decking seam, and a second position in which the wheels are lifted off of the decking sections when the tool is actuated.

In another aspect, alone or in combination with any previous aspect of the first embodiment, the actuator is a pneumatic cylinder, a hydraulic cylinder, or an electrical motor.

In another aspect, alone or in combination with any previous aspect of the first embodiment, the pneumatic cylinder comprises a housing comprising a wall having a substantially circular interior cross section; a flexible diaphragm disposed within the housing and sealed along an outer edge thereof to the wall to divide the housing into a first and second chamber, the first chamber having a fitting adapted to receive a source of high pressure air, the second chamber having at least one opening for venting the second chamber to the atmosphere, the diaphragm being adapted to be operatively attached to the piston rod passing through the second chamber; and a spring disposed in the second chamber for urging the diaphragm toward the first chamber.

In a second embodiment, a method of forming a side-lapping joint in decking is provided. The method comprising forming a plurality of sheared louvers alternating in their horizontal projection along a longitudinal axis of the side-lap seam of a decking; and crimping along one or more of a top section and/or a bottom section of the side-lapped joint.

In one aspect of the second embodiment, the forming step and crimping step are performed essentially simultaneously.

In another aspect, alone or in combination with any previous aspect of the second embodiment, the forming step comprises the tool as defined in any of aspects of the first embodiment.

In a third embodiment, a structure comprising metal decking joined by the method as defined in any of the aspects of the second embodiment is provided.

DETAILED DESCRIPTION

Figure 1:
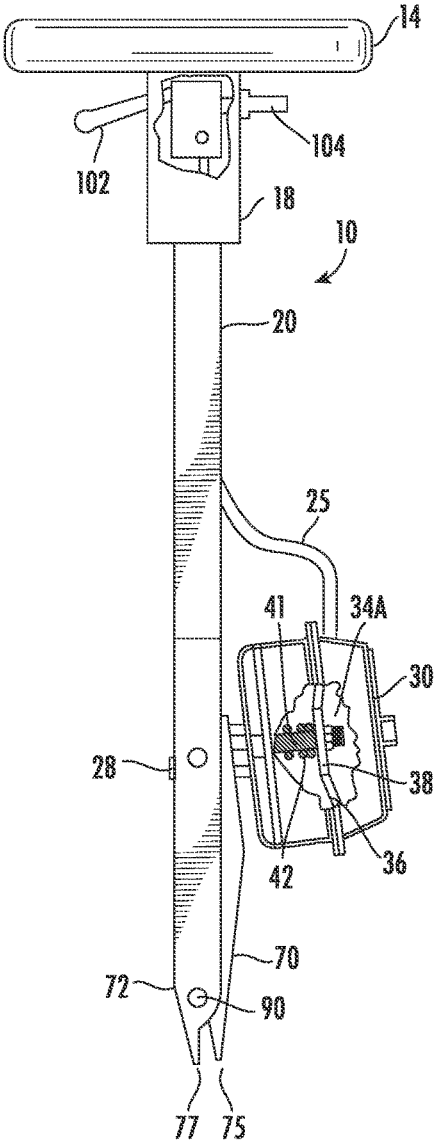
FIG. 1 is a first side plan view of an illustrative device in an initial state, incorporating features of the present disclosure.

The present disclosure relates to tools for forming features in the joints of structural steel decking and roofing commonly used in commercial construction, for example, decking used as support for poured concrete floors or as roofing for industrial and other buildings or structures.

The drawing figures are intended to illustrate the general manner of construction and are not necessarily to scale. In the description and in the claims, the terms left, right, "side", front, back, first, second, and the like are used for descriptive purposes. However, it is understood that the embodiment of the disclosure described herein is capable of operation in other orientations than is shown and the terms so used are only for the purpose of describing relative positions and are interchangeable under appropriate circumstances. Throughout the present disclosure, the words "device" and "tool" are used interchangeably.

Figure 2:
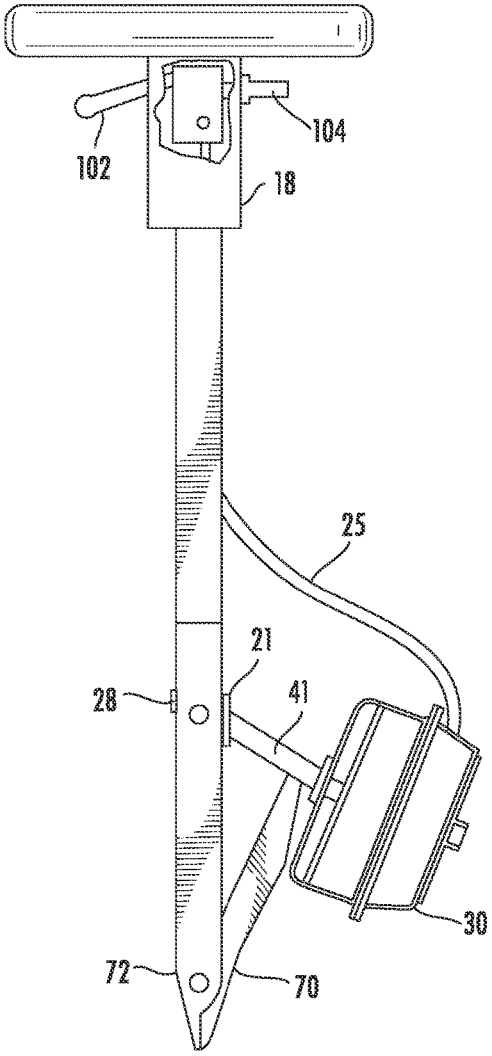
FIG. 2 is the first side plan view of an illustrative device in an activated state, incorporating features of the present disclosure.

Thus, referring to FIGS. 1 and 2, FIG. 1 depicts a first side plan view of an illustrative device in an initial state, incorporating features of the present disclosure. FIG. 1 depicts an initial state and FIG. 2 depicts an activated state, respectively of an illustrative embodiment of tool 10 comprising a support 20 having a handle 14 adapted to be grasped by a user at about waist level so that the lower extreme of tool 10 is at about foot level. Handle 14 is shown connected to the top end of the extension box 18, which in turn is connected to support 20. Handle can be of a variety of configurations, such as a bar, a tube, or a vertical pipe. Handle 14 is shown as a bar which extends transversely to extension box 18. Handle 14 should be suitably close to the trigger mechanism 102 so as to allow the operator to access the trigger mechanism for the delivery of air pressure into the actuator 30 and for the proper use of tool 10.

A conventional air valve is housed within extension box 18 and regulates a source of pressurized air admitted through fitting 104 and provides a pressurized output into hose 25 for admittance into actuator 30. Support 20 may be constructed of individual plates welded together to form a hollow rectangular structure, so as to minimize weight. In another aspect, a hollow tube can be used for the handle 14 and/or support 20. Support 20 and/or handle 14 and/or extension box 18 can be configured for assembly/disassembly or be integrated together, e.g., welded, or can be configured for adjustment of the tool's height by the user.

Still referring to FIGS. 1 and 2, the central section of support 20 supports a stationary arm 72 and a first jaw 77. Stationary arm 72 can be assembled to support 20 by conventional fastening means, such as bolts, pins, dovetails, and the like. Actuator 30 is showed attached to one end of moveable arm 70, with opposite end of arm 70 terminating at second jaw 75. Moveable arm 70 and actuator 30 are configured opposite that of stationary arm 72 and corresponding second jaw 75, with movable arm 70 pivotally attached with pin 90 at the lower end of stationary arm 72, so as to provide a reciprocating open and close relationship, as further discussed below. In the initial state, tool 10 has jaws 77, 75 open, as shown in FIG. 1. In one aspect, pin 90, which functions as a central axis bolt, can be employed with a bushing so as to minimize or eliminate heat build up, and/or wear of moving elements caused by the repetitive movement of the arm during use, thus extending the interval between repair, maintenance, or replacement. The bushing can be metal, metal alloy, polymer, polymer composite, ceramic, carbon, carbon fiber, and the like. In one aspect, the bushing is bronze, oil impregnated bronze, or brass.

Still referring to FIGS. 1 and 2, actuator 30 receives a source of air pressure from fitting 104 via flexible hose 25 which is operably connected to the trigger mechanism 102. FIG. 2, which depicts tool 10 in its activated state, shows moveable arm 70 moved away from stationary arm by extended piston 41. Terminal end of piston 41 is received by piston seat 21. Piston seat 21 is secured to stationary arm 72, causing piston 41 to push off of stationary arm with activation of actuator 30. In the activated state, tool 10 has jaws 77, 75 closed, as shown in FIG. 2. Movement of the moveable arm 70 and actuator 30 are shown by arrows in FIG. 2.

Stationary arm 72 and/or moveable arm 70 can be of metal or non-metal plate, tube, or a cast construction. Alternatively, one or more of the handle, support, and stationary/moveable arms can be constructed of engineering resins or plastics, composite materials, reinforced plastics, wood/wood composite, fiberglass, metal, or can be a combination of one or more of such materials, provided that such material construction can tolerate the expected wear and tear of the tool during use, transport, storage, and/or repair.

Figure 3:
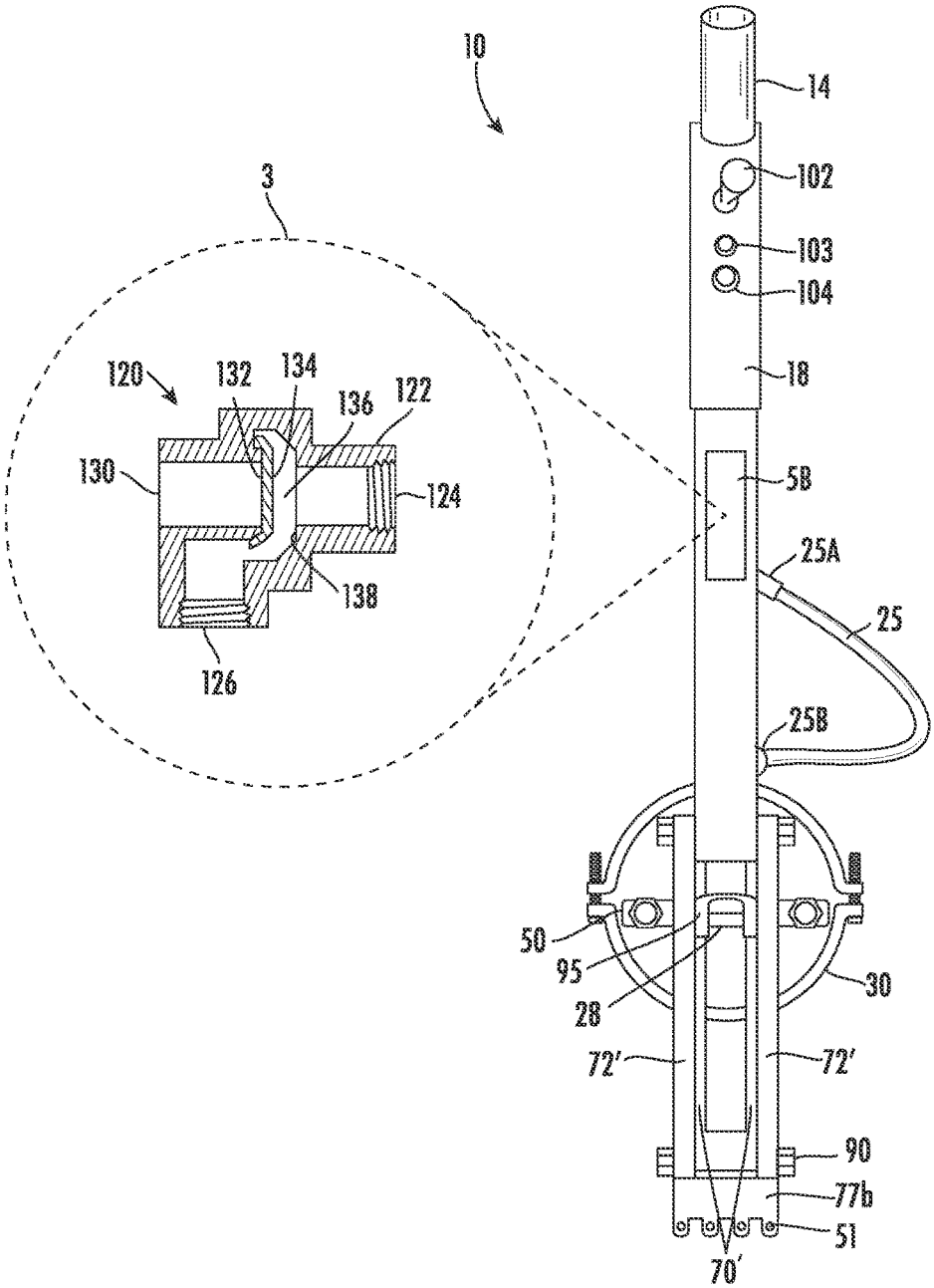
FIG. 3 is a perspective, reverse side view of the apparatus of FIG. 1, with exploded section of bi-controller air valve.

FIG. 3 is a perspective view of one side of tool 10 showing actuator 30 directly mounted on movable arm 70, which is shown by way of cross-bar 50, secured by threaded nuts and corresponding bolts. Turnbuckle 95 is pivotably secured to stationary arm 72, for example, by a clevis or similar engagement, as shown, through to stationary arm 72 by clevis pin 28. Turnbuckle 95 pivotably secures piston seat 21, which receives terminal end of piston 41 projecting from actuator 30. Turnbuckle 95 is pivotably mounted to stationary arm 72 so as to allow for some arc-like motion in the stroke of piston 41. Turnbuckle 95 can also be used to adjust the length of stroke of moveable arm 70 by adjusting the position of piston seat 21 relative to stationary arm 7. In one aspect piston seat projects outwardly from the stationary arm in the direction of actuator 30 so as to minimize the piston stroke distance. Alternatively, piston seat 21 can be mounted on the (out)side or face of stationary arm 70 closest to actuator 30, for example, using a cross-bar or bracket mounting arrangement.

By having moveable arm 70 carry actuator 30, and having fixedly positioned the opposite end of piston 41 in piston seat 21, total piston stroke length is minimized, reducing the overall size of actuator needed to drive the piston, which in turn at least reduces the weight of the tool. Minimizing the stroke length can further provide for more speed/cycle time, more power, less wear, and reduced cost of manufacturing.

Smaller actuators allows for smaller sized piston (diameter, length), further reducing weight, cost, and replacement/repair.

With reference to FIG. 3, stationary arm 72 is shown in an exemplary configuration having two parallel extensions 72' with their corresponding first ends mounted to support 20 and corresponding second ends pivotably joined to moveable arm 70, respectfully, for example about pin 90. Moveable arm 70 is shown in this exemplary configuration also constructed of two parallel extensions 72' with one pair of its corresponding ends coupled to (or integral with) cross-bar 50 and its corresponding opposite ends pivotably joined with ends of stationary arm 72 via pin 90. The shown arrangement of the parallel extensions of the stationary and moveable arm can be reversed to that shown in FIG. 3. Alternatively, stationary arm 72 can be configured as a single extension with opposing side edges, with movable arm 70 having each of its parallel extensions pivotably mounted on the opposing side edges of such stationary arm using pin 90, for example. Other configurations of stationary/moveable arms can be used.

As shown in exploded view 3 of FIG. 3, a bi-directional valve 120 can be operatively disposed between fitting 104 and actuator 30 to admit pressurized air when trigger mechanism 102 is toggled and to exhaust air from actuator 30 when trigger mechanism 102 is released, thereby allowing actuator 30 to return to its upper limit of travel more rapidly, and thereby increasing the cycle rate of the apparatus. As discussed above, cycle rate can be further improved by the combination of bi-directional valve 120 with the shortened piston stroke, and by mounting actuator 30 on moveable arm 70.

As shown more fully in exploded view 3 of FIG. 3, bi-directional valve 120 comprises a housing 122 having inlet 124 which is threaded to receive a standard hose or tube fitting, outlet 126 which is threaded to form an airtight seal with hose 25 feeding actuator 30. Housing 122 further comprises exhaust port 130 and valve seat 132 formed on the inner surface of exhaust port 130. Flexible valve member 134 is constrained within chamber 136 of housing 122. As high pressure air enters through inlet 124, valve member 134 is forced against valve seat 132 to close off exhaust port 130 and direct the flow of air through outlet 126 (into actuator 30). Toggling trigger mechanism 102 and terminating air flow causes air from actuator 30 to reverse direction and enter housing 122 through outlet 126. This reversed flow of air through outlet 126 causes valve member 134 to seat against surface 138, thereby opening exhaust port 130 to permit relatively unobstructed exhaust of pressurized air from actuator 30. Other de-pressurizing controls alone or in combination with the presently disclosed tool can be used. Actuator 30 can comprise vents/openings (not shown) in its housing to vent pressure.

In an alternate exemplary embodiment of the tool herein disclosed, one or more wheels can be attached thereto. Thus, a wheel assembly comprising on each side of the tool, one or more wheels coupled to, for example, an adjustable or telescoping extension projecting from the stationary arm 72. The wheel assembly can be adapted to move between a first position in which the wheels are in contact with decking sections for transporting the tool along the decking seam, and a second position in which the wheels are lifted off of the decking sections when the tool is to be used or actuated. The wheel assembly can comprise, among other things, one or more wheels configured for attachment to a stationary support or member arms, which in turn is attached to a telescopic adjustment member arms. Support and telescopic arms can be secured together by a fastener, and the support arm can be mounted to stationary arm 72 by a bracket or other means. Other attachment configurations can be used to mount the wheel assembly. In one aspect, a single wheel assembly can be configured, the single wheel assembly mounted to the stationary arm 72 on the opposite side of that of moveable arm 70. For the single wheel arrangement, the wheel can be configured with a groove, the groove a width capable of accommodating the seam of the decking (before and/or after joining), or the wheel arrangement can be two wheels spatially separated to accommodate the width of the seam in the decking. Alternatively, or in combination, a kick-stand can be attached to stationary arm 70 or wheel assembly so as to allow the tool to be left in an upright or vertical position when not in use, avoiding potential damage to actuator 30 and hose 25 when tool is otherwise left or placed in a horizontal (laying on the surface) position.

Figure 4:
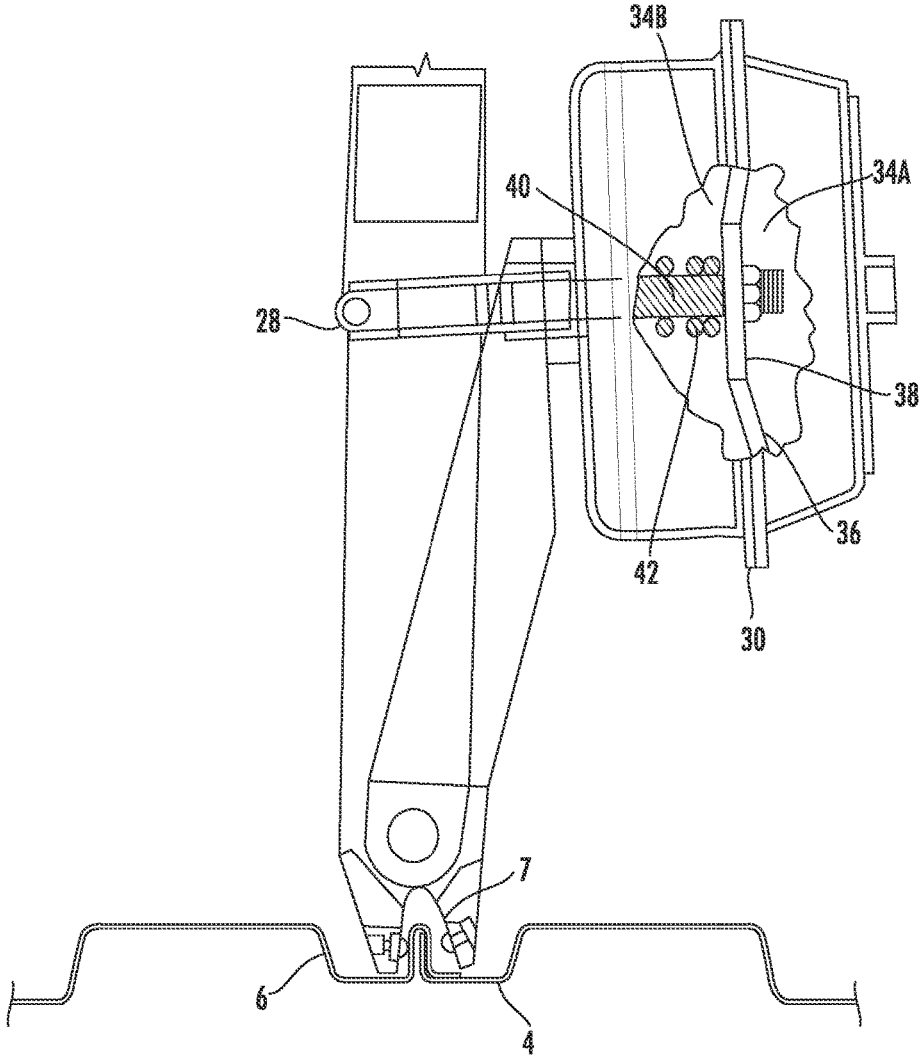
FIG. 4 is a partially transparent perspective view of the apparatus of FIG. 1, shown in use on decking in accordance with the present disclosure.

With reference to FIG. 4, exemplary actuator 30 is shown to comprise piston 41 inside a bore or other conventional pneumatically actuated linear motor. In one aspect, actuator 30 comprises a housing which is divided into upper and lower chambers 34A and 34B by a diaphragm 36, which is crimped or otherwise sealed along the periphery of the housing of actuator 30. The center portion of diaphragm 36 is covered by a piston plate 38, which acts as a rigid surface for the pressure in chamber 34A to act upon piston 41. Actuator 30 can be configured to exert a force sufficient to form a joining in decking, at an inlet pressure, for example, of 60-200 psi with a maximum stroke, for example, of about 1 to about 4 inches, or about 2 to about 3 inches, which corresponds to jaw movement of about 0.5 inches to about 3 inches, or about 0.75 inches to about 2 inches for jaws having about 2 to about 5 inch width, or about a 2.5 inch to about 3 inch width. Other inlet pressures or stroke length can be used. Thus, when used in combination with the stationary arm/moveable arm as described herein, the actuator 30 provides the force and displacement necessary to cut, punch, shear and/or form a louver (as described hereinafter) in virtually all standard structural steel decking in a single-pass operation.

Again with reference to FIG. 4, piston 41 is attached to piston plate 38 in order to convert the pressure action on piston plate 38 and diaphragm 36 into a force for actuating the jaw mechanism as herein described. Return spring 42 acts against the pressure in chamber 34A to return the piston plate 38 (and piston 41) to the upper limit of travel when pressure in chamber 34A is equal to the pressure in chamber 34B, and to return moveable arm 70 to its initial position. As described above, the lower end of piston 41 is received by piston seat 21, the piston seat being secured, for example, by a turnbuckle 95 and clevis, through which passes a clevis pin 28.

Other mechanisms for powering the reciprocation of piston 41 to drive moveable arm 70 can be used. The actuator used to reciprocate piston 41 need not be hydraulic or pneumatic; for example, an electric motor could also be used to advance and retract piston 41. Within the concept of the present disclosure, the actuator can take a wide variety of configurations. In particular, a variety of other linkages can be implemented so as to allow for the proper movement of the moveable arm 70. As used herein, the term "actuator" can also take on a wide variety of configurations. For example, it is possible for the actuator to work by having the air supply retract the piston within the actuator 30. As a result, through suitable linkages, the moveable arm and jaw can move in an opposite orientation to that described. Within the concept of the present disclosure, it is possible that hydraulics or electrics could be used in place of or cooperatively with the pneumatics described above that are associated with the actuator.

In normal use, when the trigger mechanism 102 is actuated, air will flow through inlet 104 through the air hose 25 so as to create a pushing force on the piston within actuator 30 against the piston seat 21 on stationary arm 72. This, in turn, will move the piston 41, and the moveable arm to which it is attached, away from the stationary arm. As a result, the moveable arm 70 as it moves away from the stationary arm bring jaw 75 and its punch die/relief die toward the complementary punch die/relief die of jaw 77 of stationary arm 72. This will cause a joining of the adjoining deck sections located in the space between the punch dies and the relief die, as further discussed below. When the trigger mechanism 102 is released by the user, spring 42 within actuator 30 will urge the piston upwardly within the actuator. This will cause piston 41, and the associated moveable arm 70, to move inwardly towards stationary arm 72 and open the jaws.

Again with reference to FIG. 4, which depicts tool 10 in operation on decking, as shown, tool 10 is positioned on the side-lap of the decking with jaws 75, 77 in an open (initial) position spanning seam 7 of female section 6, which overlays in an envelope male section 4. Optional wheel assembly, not shown, can either span the vee section of the decking or ride in the vee section, or ride on either side of seam 7, so as to position the tool for forming the joint. Lifting the tool, e.g., by pivoting in a direction forward from the wheel assemble positions the opposing jaws about the seam so as to lift the wheel assembly from decking and to prevent forward motion of the tool during activation. Upon user-activation by depressing the trigger mechanism 102, high pressure air entering actuator 30 causes extension of piston 41 and pivots moveable arm 70 and jaw 75 from its initial position and closes on jaw 77 of stationary arm 72 in its activated position to crimp, cut, punch and/or form louvers in the side seams together. Release of trigger mechanism 102 by the user returns moveable arm 70 to its initial position as described above. In one aspect, the die configuration of the tool shears through the decking material and forms louvers while also crimping the male/female portions of the seam, as discussed further below.

Figure 5A:
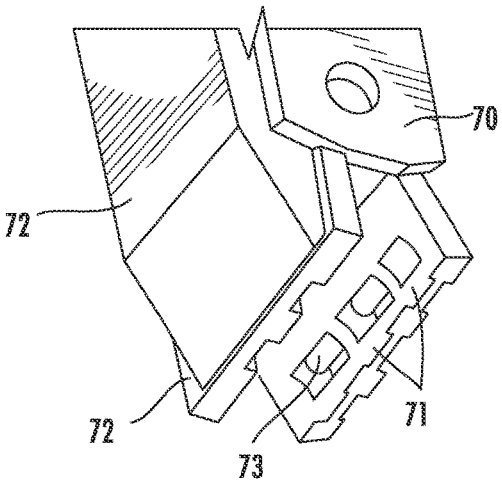
FIGS. 5A and 5B are perspective views of jaw and die configurations in accordance with the present disclosure.
Figure 5B:
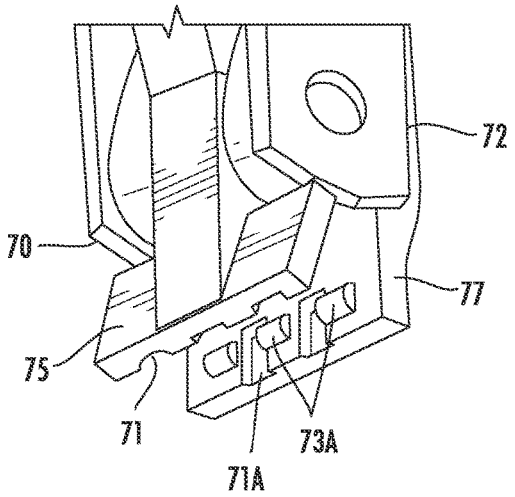

FIGS. 5A and 5B are side elevation views of an exemplary jaw configuration. Jaw 75 which is coupled to moveable arm 70 and jaw 77 coupled to stationary arm can comprise a combination of male die members (or "blades") and female die members. Thus, jaw 75 includes one or more female dies 71 spatially separated by male dies 73 (or blades). Female dies 71 can be configured as recesses in the jaw, shaped to receive the corresponding male die of the other jaw. The female die recess can be partially or completely through the jaw. As shown in FIGS. 5A and 5B, female dies are partially cut-outs (or reliefs) in jaws 75, 77. One or both of jaws 75, 77 can be configured for removal from its corresponding arm for replacement. As shown, each of jaws 75, 77 comprise a combination of spatially arranged male and female dies in a cooperative arrangement for forming louvers and joining a decking.

Figure 5C:
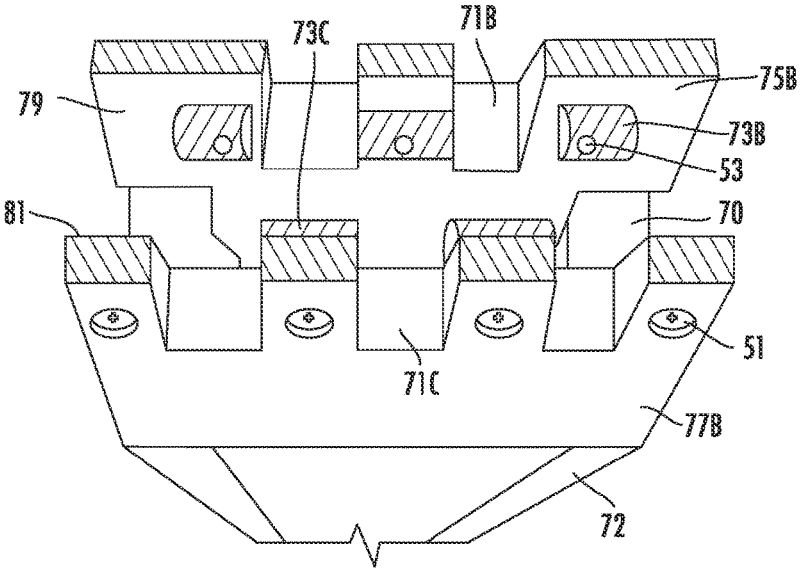
FIGS. 5C and 5D are perspective views of an alternate jaw and die configuration in accordance with the present disclosure.

FIG. 5C depicts an alternate exemplary arrangement of jaws/dies having replaceable male dies and/or other sections of the jaws. Thus, jaws 75*b*, 77*b* which is coupled to moveable arm 70 and stationary arm 72, respectively, comprises one or more male dies 73*b*, 73*c*, respectively, secured to the jaws by fastener 51, which is received by die opening 53 (e.g., threading or dove tail, etc.) providing for the removal/replacement of the dies. One or more female dies 71*b*, 71*c* are shown as recesses being spatially separated openings between projections 83*a*, 83*b*, through corresponding jaws 75*b*, 77*b*, respectively. Female dies 71*b*, 71*c* can be sized to receive male dies 73*c*, 73*b*, respectively, to shear the side-lap for forming the joining, as further discussed below. As shown, each of jaws 75*b*, 77*b* comprise a combination of spatially arranged male and female dies, in a cooperative arrangement for forming the joining in a decking.

Figure 5D:
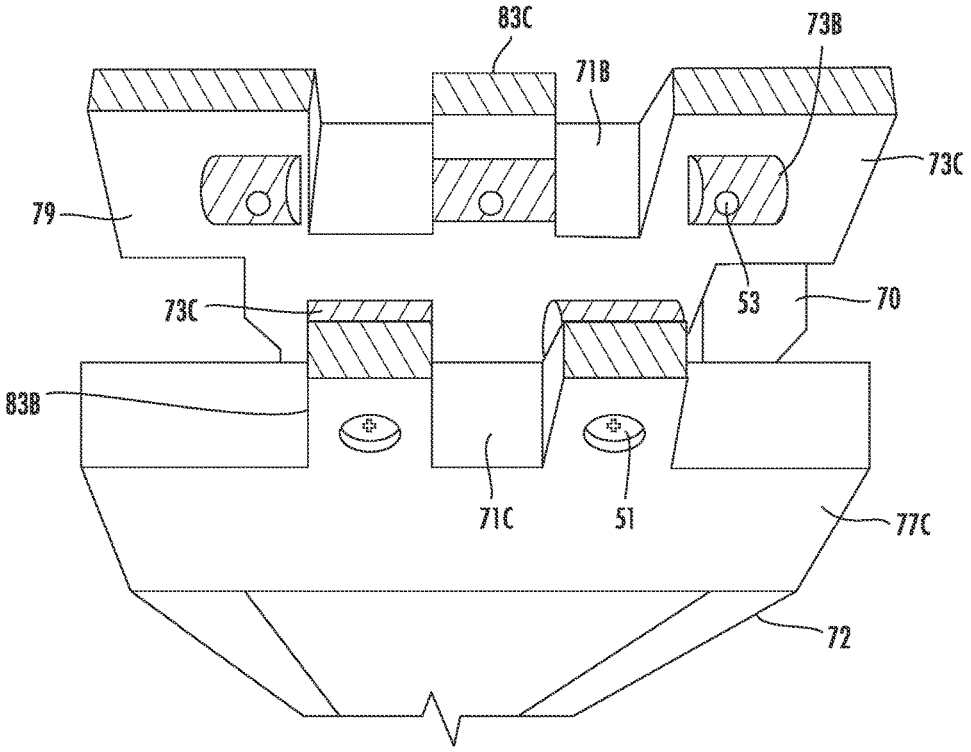

FIG. 5D depicts yet another alternate exemplary arrangement of jaws/dies having replaceable male dies and/or other sections of the jaws. FIG. 5D depicts a structure similar to that of FIG. 5C, however, fewer projections 83*b* are employed on jaw 77*c*. Thus, jaw 75*c*, is coupled to moveable arm 70, and comprises three male dies 73*b*, each secured to the jaw by fasteners 51, which is received by die opening 53 (e.g., threading or dove tail, etc.) providing for the removal/replacement of each of the male dies (or blades). Correspondingly, jaws 77*c*, which is coupled to stationary arm 72 comprises two male dies 73*c* secured to the jaw by fastener 51, as above. Two female dies 71*b* on the moveable arm 70, and one female die 71*c* on the stationary arm 72 are shown as spatially separated openings between projections 83*a*, 83*b*, through corresponding jaws 75*c*, 77*c*, respectively. Female dies 71*b*, 71*c* can be sized to receive male dies 73*c*, 73*b*, respectively, to shear (and/or deform, and/or punch) the side-lap for forming the joining, as further discussed below. As shown, each of jaws 75*c*, 77*c* comprise a combination of spatially arranged male and female dies, in a cooperative arrangement for forming the joining in a decking.

In one aspect, jaws 75*b*, 77*b* can be of a construction having a first hardness and one or more dies 73*b*, 73*c* can independently be of a second hardness that is the same or greater than that of the first hardness. In one aspect, dies 73*b*, 73*c* can independently be of a second hardness that is greater than that of the first hardness. This configuration provides for the advantage of needing to replace only the dies and not the entire jaw, saving time and cost and/or providing for controlled wear of the dies.

In the exemplary alternate jaw configuration of FIG. 5C, area 79 of jaw 75*b*, and on opposite end adjacent die 73*b*, can be sized to receive area 81 of opposing jaw 77*b* to provide a wave like crimp (or other structural shape) to section 170 of the decking joining. In another aspect, as in the exemplary alternate jaw configuration of FIG. 5D, area 79 of jaw 75*c*, and on opposite end adjacent die 73*b*, can be configured to receive a portion of the side-lap without a corresponding area of opposing jaw 77*c* so as to provide a wave like crimp (or other structural shape) to section 170 of the decking joining. Either of these areas can comprise replaceable sections of the same or different hardness as described above. Likewise, FIGS. 5A and 5B depict this arrangement. In FIGS. 5A-5D, spatial separation of the male/female dies can be linear or non-linear, and can be transverse to the longitudinal axis of the tool or parallel thereto. Height, width, length (and depth and/or width of female die), and spatial distances between each of the male/female dies can be optimized for the particular decking to be worked and the geometry and configuration of the louver desired. Various patterns of male/female die arrangements can be used. In one aspect, both male/female dies alternate in spatial relationship on both of the corresponding jaws.

Figure 6:
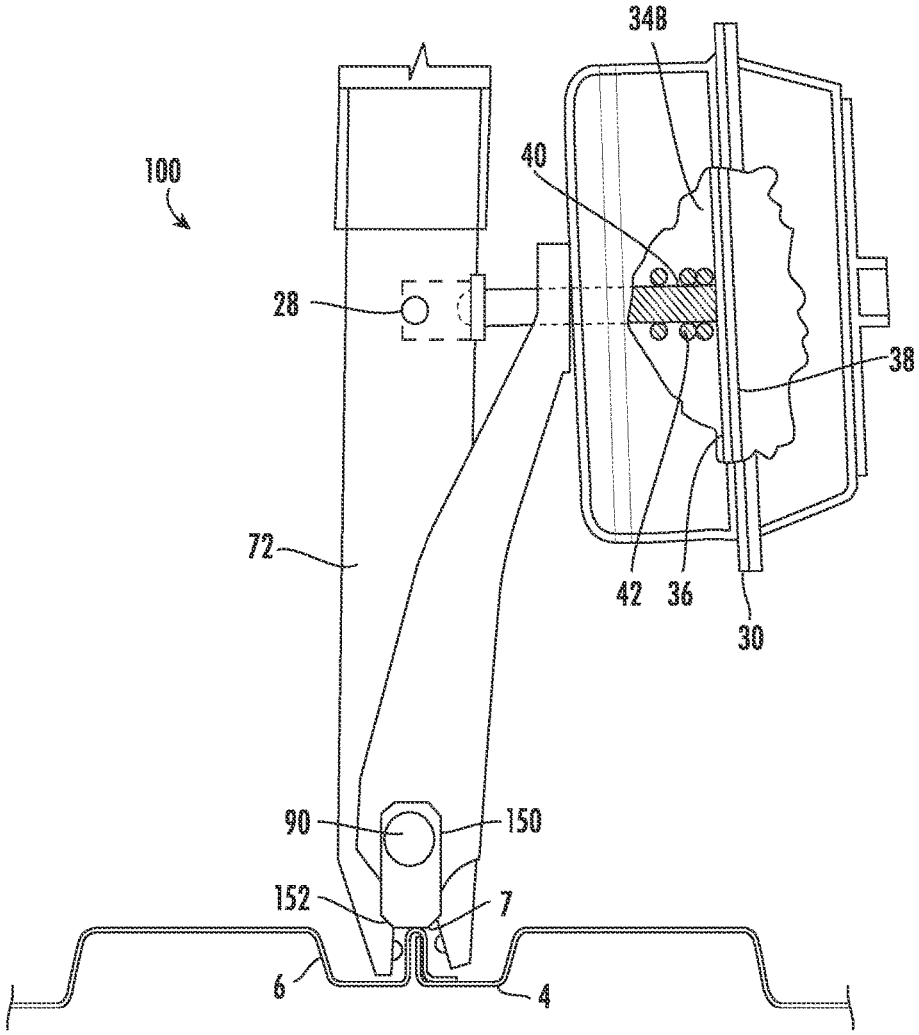
FIG. 6 is a partial side view of an additional embodiment of the illustrated device of FIG. 1.

FIG. 6 depicts an embodiment of tool 100 useful for indexing the jaws and dies during operation of the tool on decking. Thus, FIG. 6 is a partial side perspective view showing indexer 150 of generally rectangular shape, however, any shape can be used, such as circular, oval, square, triangular, U shape, C shape, T-shape, etc. Indexer 150 is configured for attachment to tool, as shown in conjunction with pin 90. Indexer 150 can be attached, for example, to stationary arm 72. Indexer 150 has a surface 152 configured to contact the top of lap seam 7 of the decking. Surface 152 (or the indexer itself) can be of a low-friction material, such as Teflon or carbon fiber, or can be of a metal, metal alloy, plastic, composite, graphite, ceramic, or the like. In use, indexer 150 provides for the distal ends of the jaws to remain slightly above the decking and thus, avoids scraping and/or gouging of the decking by the motion of the jaws during activation. Indexer 150 can be configured to provide for a predetermined height (or clearance) of the jaws from the decking and/or lap seam. Indexer 150 can be configured for variable height or clearance adjustment, for example, by having openings along its longitudinal length for attachment to the pin 90 or stationary arm 72. One or a pair of indexers can be employed, for example, on both sides of pin 90. Thus, in one aspect, a pair of indexers is configured to position the distal end of the jaws 75, 77 while in the initial position and straddling a lap seam joint between the top of the of the lap seam and its base. In this configuration, the distal end of the jaws does not contact or slide along the decking (or base of the lap seam joint) when the tool is activated. In one aspect, indexer 150 adjusts and/or controls where the dies provide the louvers within the height of the sidelap.

Figure 7:
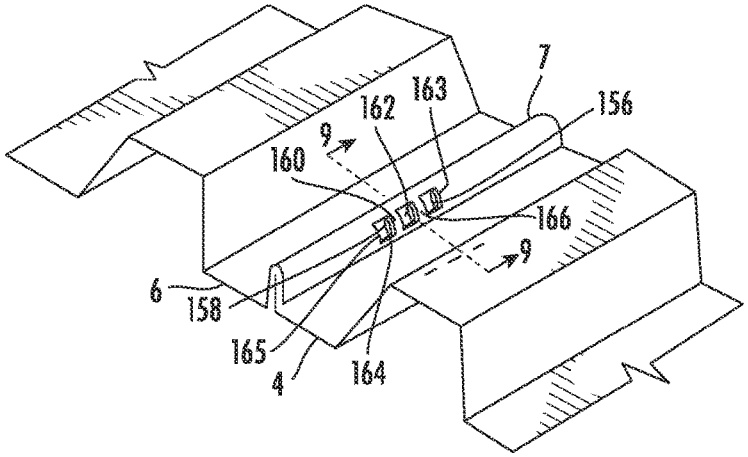
FIGS. 7 and 8 are perspective views of a portion of decking having formed therein a structural louver in accordance with the present invention.
Figure 8:
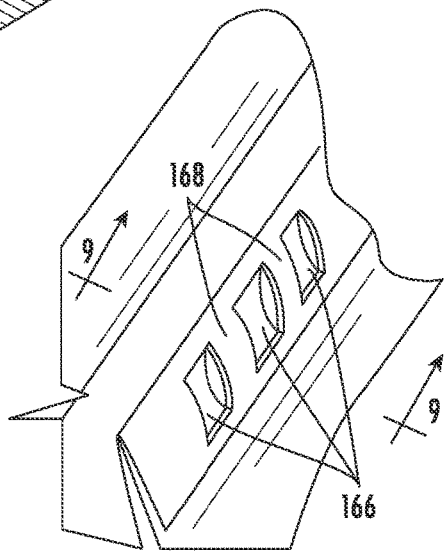
Figure 9:
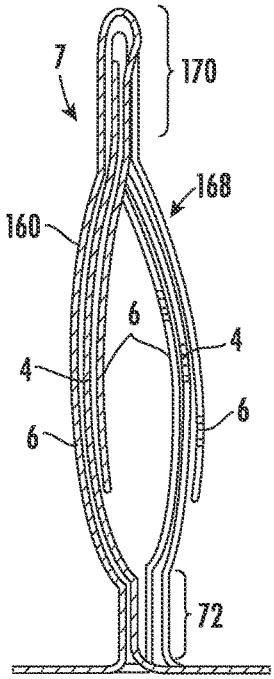
FIG. 9 is a cross-sectional view of the decking of FIG. 8 taken along line 9-9.

FIGS. 7, 8, and 9 show perspective views of the decking after tool activation and a sectional view of the worked area along line 9-9, respectively. As shown in FIGS. 7 and 8, the individual decking or roofing panels are typically provided with one edge having an exposed upward "male" lip 4. The opposite edge is provided with an inverted "U" shaped relief (e.g., "female") lip 6. The individual panels are typically joined together to form a seam 7 by placing the female lip 6 over the male lip 4 and crimping the seam at periodic intervals. The jaws of the presently disclosed tool close the seam 7 while the upset portion formed by the die form an upset that adds lateral resistance to the seam 7. In certain aspects, the tool and die configuration as disclosed herein provides for a louver or louver-like joining having louvers projecting in opposite directions relative to line 9-9, as depicted in FIG. 8. Configuration of tool and die disclosed herein provide for side-lapped joints in decking that are punched and sheared, as well as crimped by a single activation. Thus, multiple louvers, having opposing (e.g., alternating or other pattern) horizontal projections (e.g., 160 and 168 of FIG. 9) relative to the longitudinal axis of the decking (line 9-9) with a wave-like crimped section (e.g., 170 of FIG. 9) in proximity to upper section 7 of the side-lapping can be formed using the tool and die configurations herein disclosed. Such joinings can provide superior performance attributes (e.g., shear resistance and load bearing ability) to the decking and/or to the structure relative to other joinings having button-punching, sheet metal screws, riveting, or other mechanical deformation joinings.

As shown in FIG. 9, which is a side view of two adjacent louvers of FIG. 7 or 8, the displaced tab 160 (e.g., into page) comprising crimped portions of lip 4 and "U" shaped lip 6 is displaced in a direction opposite the reveal portion 168 (out of page) of window 166. If seam 7 is subjected to a shear loading in the direction along 9-9, the displaced tab 160 will bear against the reveal portion 168 of window 166 in the regions indicated at 170 and 172 (upper and lower regions, respectively) reducing or eliminating prying on tab 160 or otherwise restoring displaced tab 160 to its original configuration under such shear loading, thus resulting in an improved joining, for example, as compared to a button punch or screw joining. Accordingly, in order for the seam to shift laterally, tab 160 would need to be sheared in the 9-9 direction by reveal 168 of window 166. Accordingly, the shear strength of a seam 7 sheared and upset using the joining tool herein described has a lateral stiffness that approaches the shear strength of the decking material itself.

Figure 10:
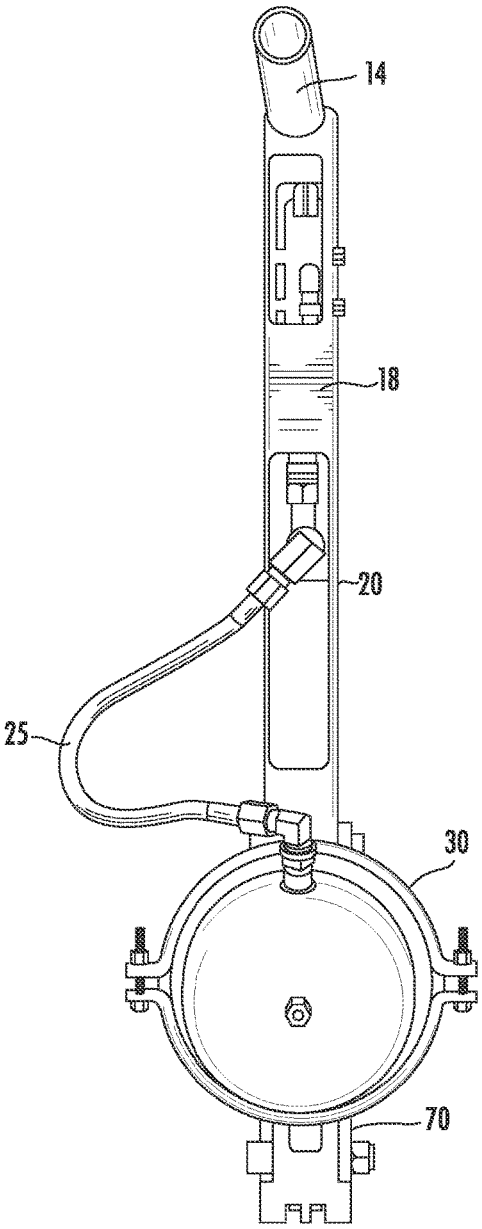
FIGS. 10-15 are first side, second side, third side, fourth side, and close ups of the third and the fourth sides of device in its activated state, respectively, of the illustrative device of FIG. 1.
Figure 11:
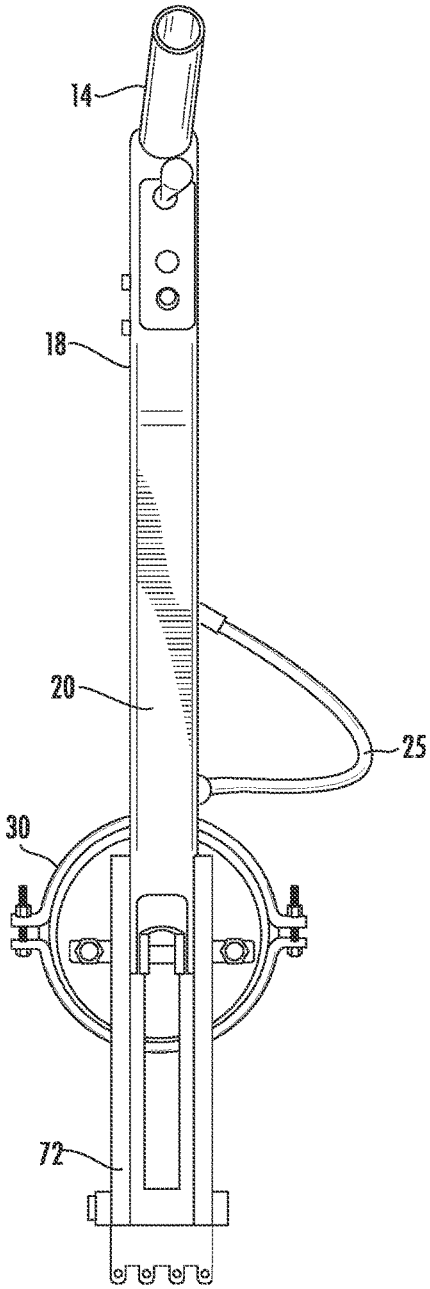
Figure 12:
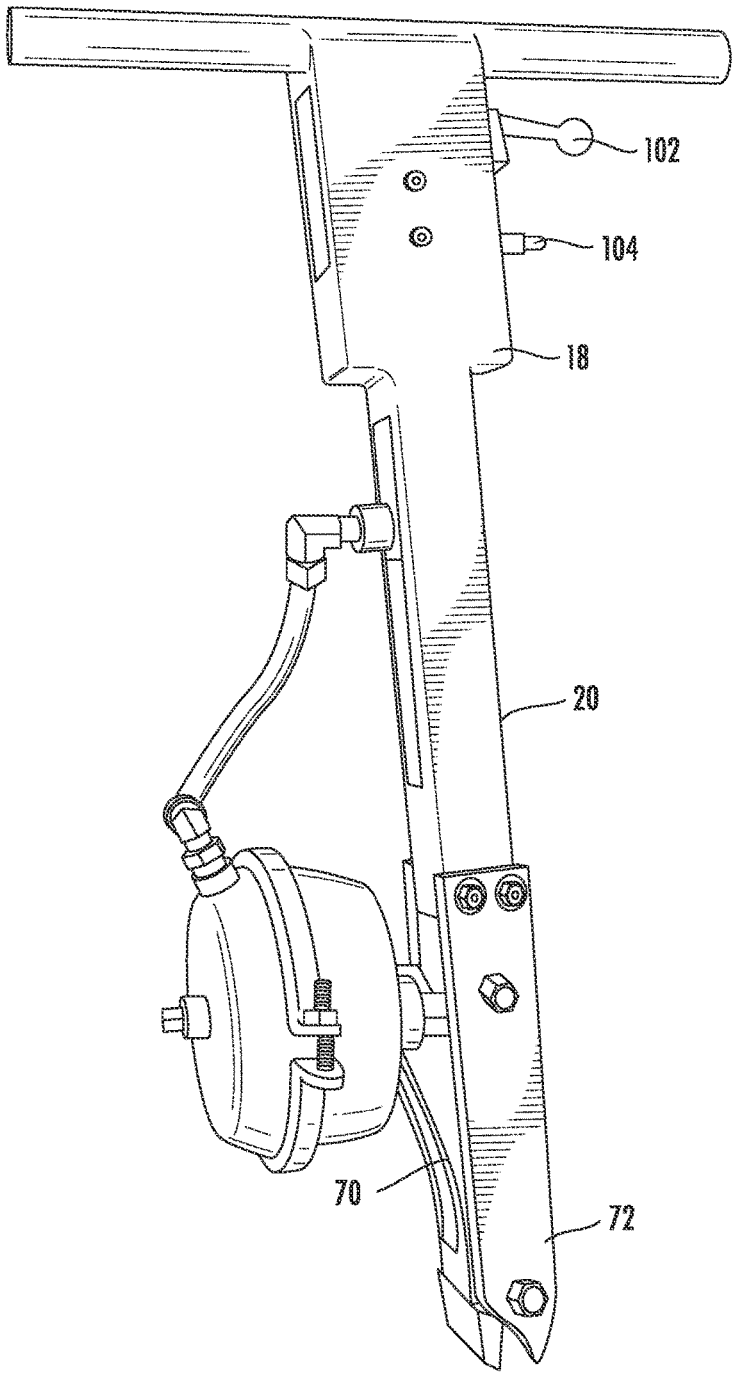
Figure 13:
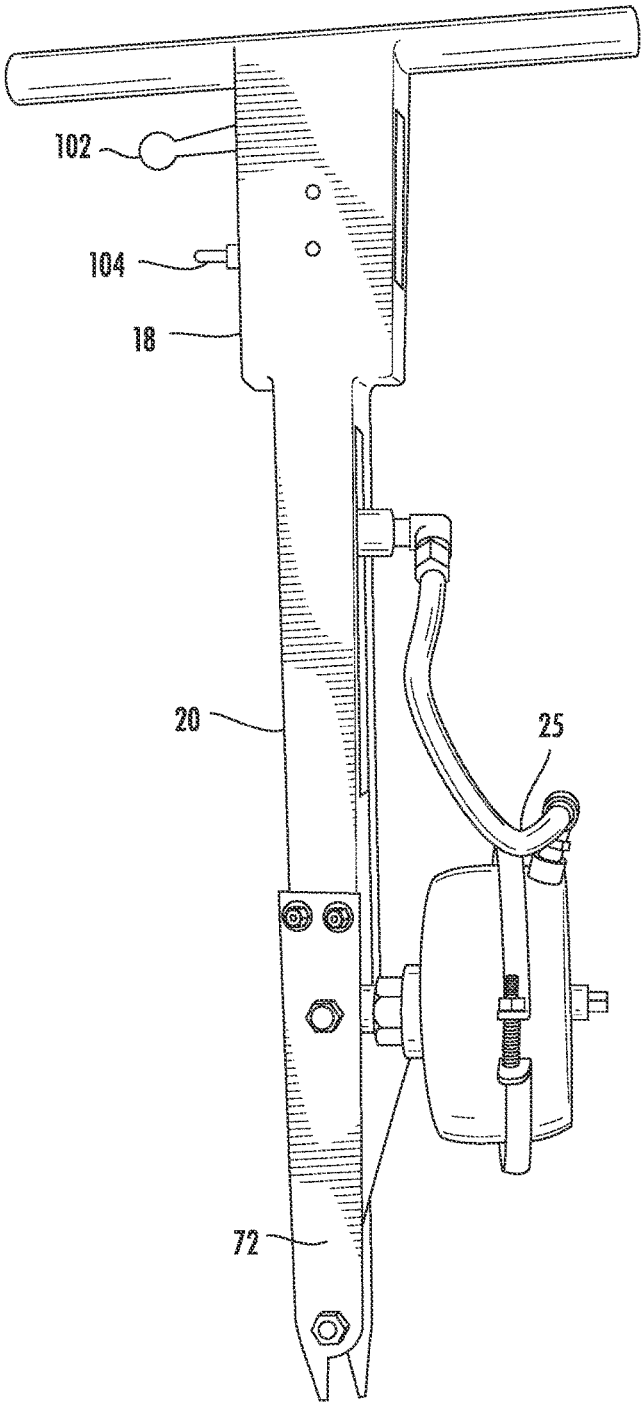

FIGS. 10 and 11 show first and second side views of tool 10 in its initial state, showing hose couplings 25*a*, 25*b*, with hose 25 connecting on one end to support 20 via coupling 25*a* and to actuator 30 on opposite end via coupling 25*b*. Support 20 has box 18 for housing connections, trigger mechanism 102, for and threading hosing as well as supporting handle 14. FIGS. 12 and 13 show third and fourth side views of tool 10 in its initial state, showing turnbuckle 95 and actuator 30 mounting configuration.

Figure 15:
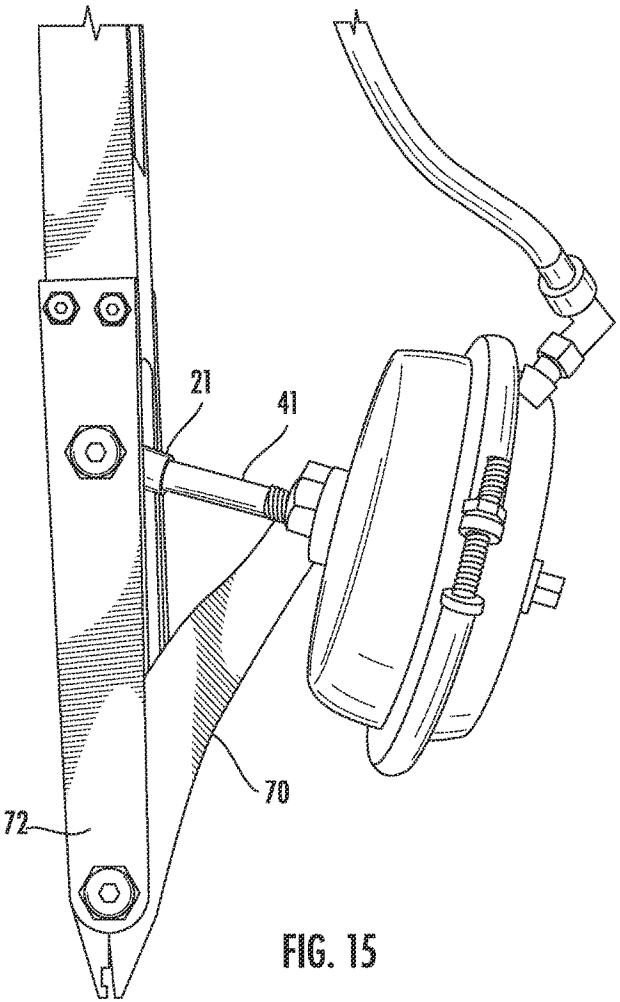
Figure 14:
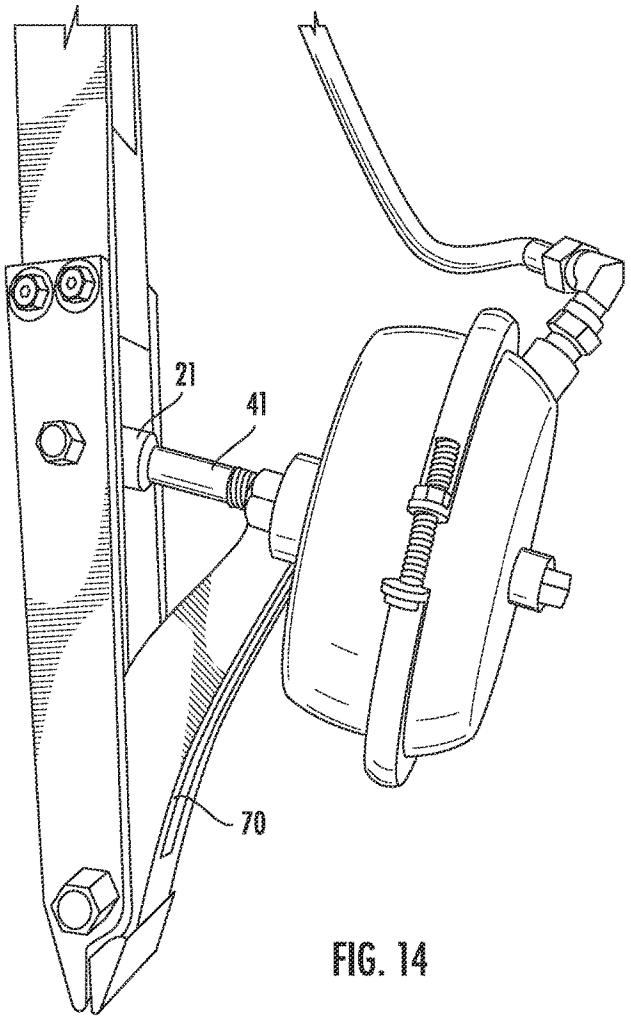

FIGS. 14 and 15 show close up views of the first and the second sides, respectively, of tool 10 in an activated state showing piston 41 extended against seat 21 and moveable arm 70 moved from stationary arm 7, with jaw 75 of moveable arm 70 in a closed relationship against jaw 77 of stationary arm 72.

The aforementioned tool, in combination with jaw/die configurations, for example, as depicted in FIGS. 5A-5D, provide for a tool capable of forming side-lapped joinings comprising sheared louvers alternating in their horizontal projection along the longitudinal axis of the side-lap seam, and crimping along the top section (and/or bottom section) of the side-lapped joint. Such formed side-lapped joints are believed superior to conventional joinings made by other deformations or fastenings.

Alternate cuts, punches, louvers, and combinations thereof, can be made in adjoining sections of steel decking using the tool herein described by configuring the size, position, arrangement, and shape of the independent male dies (or blades) and female dies of the opposing jaws in the tool described herein. The tool can be configured so that the deck sections are loosely connected together or more rigidly connected. The shape of the cuts, punches, and/or louvers can be suitably shaped and/or arranged for providing joinings that substantially prevent lateral shifting of the sections with respect to each other or from pulling away from each other. Shapes of the cuts, punches, or louvers can be, for example, round, square, rectangular, and/or triangular-shaped. The crimping formed by the tool herein described can also impart a wave-like appearance and/or other pattern in the joined section, for example, at top region 170 of the joining.

In another aspect, buildings with improved structural attributes constructed with steel decking joined using the tool and/or die configurations described herein are provided. The tool design (weight, speed, power, die replacement, etc.) may provide faster and less labor intensive construction. The die configuration and resulting louver joints formed in the steel decking is believed capable of providing additional strength and rigidity to the structure, reducing or eliminating re-working of sections of the structure after inspection and/or unexpected stresses imparted to the decking during or after construction.

By avoiding two pivoting arms, the total stroke distance between the stationary/moveable arms can be minimized. In addition, since the wearing of the pivotal connections will only occur with respect to a single arm, maintenance of the present tool will be less than that associated with a pair of pivotable arms. The minimizing of the linkages results in less cost and in greater precision in the manufacturing of the tool. It is further believed that the minimization of linkages involved in the movement of the moveable arm will give greater longevity and reliability to the tool and in the formation of the joinings. Moreover, the disclosed tool includes a replaceable die assembly that provides not only for rapid replacement but for equalizing the wear on the dies, thereby avoiding excessive stress on any particular die, and extending the usable life of the tool and the quality of the joint made by the tool. In addition, providing replaceable male member dies on the jaws without requiring removal of the jaws from the tool will reduce down time and replacement/tooling costs for the end-user. The combination of male and female dies on each of the jaws of the stationary/moveable arms provides a unique louver structure comprising both shearing and crimping that is believed to result in side-lapped seam joints of higher horizontal shear loading values, and more resistance to slippage when subjected to a horizontal load than of other tools.

Those skilled in the art will now appreciate that an improved punching tool has been described for forming an attachment in an interlocking side-lapped seam of a steel deck structure which provides a solid attachment capable of resisting significant horizontal shear loads. The disclosed punching tool can be operated relatively quickly and easily by a deck installer to attach interlocking side-lapped seams of a steel deck structure. The design of the tool is capable of lightweight construction reducing fatigue and/or injury to the user. The resulting side-lap attachment can be quickly and easily inspected by an inspector standing atop the assembled steel decking.

While the present disclosure has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

I claim:

1. A joining tool comprising:

a support;

a stationary arm extending from the support at one end, the stationary arm comprising at an opposite end a first jaw;

a moveable arm pivotally mounted on the stationary arm, the moveable arm comprising a second jaw;

an actuator fixedly mounted on the moveable arm, wherein the actuator comprises a piston operatively coupled to the stationary arm and the actuator, wherein the moveable arm is driveable from the stationary arm in a pivotable motion by the actuator and wherein the actuator moves with the moveable arm, and wherein the moveable arm is moveable between an activated position in which the second jaw engages the first jaw and an initial position in which the second jaw is spaced from the first jaw; and at least one indexer operatively coupled to the support, the stationary arm, the moveable arm, the first jaw, or the second jaw, wherein the at least one indexer is configured to contact decking while the stationary arm and the moveable arm straddle a side-lap seam and position the first jaw and the second jaw between a top of the side-lap seam and a base of the side-lap seam while in the initial position, and wherein the at least one indexer contacts the decking before the stationary arm or the moveable arm contact the decking.

2. The tool of claim 1, wherein the first jaw comprises at least one first male die and at least one first female die arranged in spaced linear alignment in correspondence with at least one second male die and at least one second female die arranged in spaced linear alignment on the second jaw.

3. The tool of claim 2, comprising a plurality of first and second male dies and a plurality of first and second female dies, both of which are arranged in spaced linear alignment, the male dies extending transverse to a longitudinal axis of support.

4. The tool of claim 2, wherein the at least one first male die and the at least one second male die each have a generally cylindrical cross section, and the at least one first female die and the at least one second female die each have a recess to receive mating male dies.

5. The tool of claim 1, wherein the actuator comprises a piston-and-cylinder assembly with the piston extending therefrom, the piston having an end opposite the piston-and-cylinder assembly connected to the stationary arm, the piston extending away from the stationary arm.

6. The tool of claim 1, wherein the piston is generally perpendicular with the stationary arm when in a retracted position.

7. The tool of claim 1, wherein the actuator is a pneumatic cylinder, a hydraulic cylinder, or an electrical motor.

8. The tool of claim 7, wherein the pneumatic cylinder comprises:

a housing comprising a wall having a substantially circular interior cross section;

a flexible diaphragm disposed within the housing and sealed along an outer edge thereof to the wall to divide the housing into a first and second chamber, the first chamber having a fitting adapted to receive a source of high pressure air, the second chamber having one or more openings for venting the second chamber to an atmosphere, the diaphragm being adapted to be operatively attached to the piston passing through the second chamber; and a spring disposed in the second chamber for urging the diaphragm toward the first chamber.

9. The tool of claim 1, wherein the at least one indexer is configured for adjustment in order to contact the decking to space the stationary arm or the moveable arm from the top of the side-lap seam.

10. The tool of claim 1, further comprising:

a bi-directional valve operatively coupled to the actuator.

11. The tool of claim 1, further comprising:

a piston seat operatively coupled to the stationary arm; and wherein the piston is operatively coupled to the stationary arm through the piston seat.

12. The tool of claim 11, wherein the piston seat is located on a face of the stationary arm closest to the actuator.

13. The tool of claim 11, wherein the piston seat projects outwardly from the stationary arm towards the actuator.

14. A joining tool comprising:

a support;

a stationary arm extending from the support at one end, the stationary arm comprising at an opposite end a first jaw;

a moveable arm pivotally mounted on the stationary arm, the moveable arm comprising a second jaw, wherein the moveable arm is driveable from the stationary arm in a pivotable motion by an actuator between an activated position in which the second jaw engages the first jaw and an initial position in which the second jaw is spaced from the first jaw; and at least one indexer operatively coupled to the support, the stationary arm or the moveable arm, wherein the at least one indexer is operatively configured to contact decking while the first jaw of the stationary arm and the second jaw of the moveable arm straddle a side-lap seam and position the first jaw and the second jaw between a top of the side-lap seam and a base of the side-lap seam while in the initial position, and wherein the at least one indexer contacts the decking before the first jaw of the stationary arm or the second jaw of the moveable arm contact the decking.

15. The tool of claim 14, wherein the at least one indexer is configured for adjustment in order to contact the decking to space the stationary arm or the moveable arm from the top of the side-lap seam.

16. The tool of claim 14, wherein the decking contacted by the indexer is the top of the side-lap seam.

17. A joining tool comprising:

a first arm having a first jaw;

a second arm having a second jaw, wherein the second arm is operatively coupled to the first arm;

a support operatively coupled to the first arm and the second arm;

an actuator operatively coupled to the support and the first arm or the second arm;

an indexer operatively coupled to the first arm, the second arm, or the support; and wherein the indexer is operatively configured to contact decking while the first jaw and the second jaw straddle a side-lap seam and position the first jaw and the second jaw between a top of the side-lap seam and a base of the side-lap seam while in an initial position, and wherein the indexer contacts the decking before the first jaw or the second jaw contact the decking.

* * * * *